US008201823B2

(12) United States Patent
Morikawa et al.

(10) Patent No.: US 8,201,823 B2
(45) Date of Patent: Jun. 19, 2012

(54) SHEET FEEDING APPARATUS

(75) Inventors: Shyuichi Morikawa, Ishikawa (JP); Minoru Masuda, Ishikawa (JP)

(73) Assignee: PFU Limited, Ishikawa (JP)

( * ) Notice: Subject to any disclaimer, the term of this patent is extended or adjusted under 35 U.S.C. 154(b) by 287 days.

(21) Appl. No.: 11/425,980

(22) Filed: Jun. 22, 2006

(65) Prior Publication Data

US 2007/0114716 A1 May 24, 2007

(30) Foreign Application Priority Data

Nov. 22, 2005 (JP) ..... 2005-337283

(51) Int. Cl.
*B65H 7/02* (2006.01)
*B65H 5/00* (2006.01)

(52) U.S. Cl. ..... 271/258.01; 271/10.01

(58) Field of Classification Search ..... 271/262, 271/258.01, 256, 258.04, 10.02, 147, 152, 271/153, 265.01; 399/367
See application file for complete search history.

(56) References Cited

U.S. PATENT DOCUMENTS

| | | | | |
|---|---|---|---|---|
| 3,655,183 | A | 4/1972 | Wagner | |
| 4,484,070 | A * | 11/1984 | Inoue | 250/223 R |
| 6,053,495 | A * | 4/2000 | Hara et al. | 271/263 |
| 6,203,003 | B1 * | 3/2001 | Sato et al. | 271/3.01 |
| 6,299,156 | B1 * | 10/2001 | Kaneda et al. | 271/117 |
| 6,349,936 | B1 * | 2/2002 | Muller et al. | 271/265.01 |
| 6,508,465 | B1 * | 1/2003 | Endo | 271/265.01 |
| 6,669,186 | B2 * | 12/2003 | Tunink et al. | 271/9.11 |
| 7,058,353 | B2 * | 6/2006 | Lee et al. | 399/393 |
| 7,134,659 | B2 * | 11/2006 | Sato et al. | 271/265.01 |
| 7,334,788 | B2 * | 2/2008 | Sakamaki et al. | 271/125 |
| 7,600,752 | B2 * | 10/2009 | Nakashima et al. | 271/258.01 |
| 2005/0077674 | A1 * | 4/2005 | Yamamoto | 271/265.01 |
| 2005/0231578 | A1 * | 10/2005 | Tajima | 347/104 |
| 2007/0001388 | A1 * | 1/2007 | Able et al. | 271/258.01 |

FOREIGN PATENT DOCUMENTS

| | | | |
|---|---|---|---|
| DE | 29715151 U1 | | 12/1997 |
| DE | 10028523 A1 | | 1/2001 |
| DE | 69910479 T2 | | 3/2004 |
| JP | 58011444 | * | 1/1983 |
| JP | 58011444 A | * | 1/1983 |
| JP | 61206759 | * | 9/1986 |
| JP | 63295350 | * | 12/1988 |

(Continued)

OTHER PUBLICATIONS

Japanese Patent Office, Office Action mailed Feb. 26, 2008 and Partial English Translation.

(Continued)

*Primary Examiner* — Kaitlin Joerger
*Assistant Examiner* — Patrick Cicchino
(74) *Attorney, Agent, or Firm* — Lowe, Hauptman, Ham & Berner, LLP

(57) ABSTRACT

A rotatable pick roller and a rotatable separating roller are formed integrally with a roller case. A retard roller opposes the separating roller and rotates in a direction opposite to that of the separating roller. A lift detecting sensor is mounted on the roller case. When a first sheet and second sheet that are stapled together are accidentally placed on a sheet table, the pick roller picks-up the first sheet and feed it in the gap between the retard roller and the separating roller, the second sheet abuts with the retard roller so that a portion of the first sheet and the second sheet gets lifted. The lift detecting sensor detects the lifted portion and stops rotations of the rollers.

6 Claims, 8 Drawing Sheets

FOREIGN PATENT DOCUMENTS

| | | | | |
|---|---|---|---|---|
| JP | 04-080128 | A | | 3/1992 |
| JP | 05058512 | | * | 3/1993 |
| JP | 05058512 | A | * | 3/1993 |
| JP | 05058102 | | * | 9/1993 |
| JP | 08-119492 | A | | 5/1996 |
| JP | 09-226980 | A | | 9/1997 |
| JP | 3197029 | | | 3/2003 |
| JP | 2004-182449 | A | | 7/2004 |

OTHER PUBLICATIONS

German Patent Office, Office Action mailed Nov. 6, 2008 and English Translation.

* cited by examiner

SHEET FEEDING APPARATUS

RELATED APPLICATIONS

The present application is based on, and claims priority from, Japanese Application Number 2005-337283, filed Nov. 22, 2005, the disclosure of which is hereby incorporated by reference herein in its entirety.

BACKGROUND OF THE INVENTION

1. Field of the Invention

The present invention generally relates to a sheet feeding apparatus. More particularly, the present invention relates to a sheet feeding apparatus that can detect stapled sheets.

2. Description of the Related Art

Sheet feeding apparatuses are mounted on image reading apparatuses or the like. A typical sheet feeding apparatus includes a sheet table, a sheet feeding roller, and a separating roller. A thin sheet or a stack of thin sheets, such as paper sheets, are placed on the sheet paper. The sheet feeding roller generally picks-up one sheet from the sheet table and feeds the sheet to the separating roller. The sheet feeding roller occasionally accidentally picks-up two or more sheets from the sheet table, in which case the separating roller separates one sheet from the fed sheets and feds the separated sheet to a subsequent structure. As a result, sheets are output one by one from the sheet feeding apparatus to the apparatus to which the sheet feeding apparatus is mounted.

Sometimes two or more sheets that are stapled together are stacked by mistake on the sheet table. In this event, sheet feeding roller picks-up all those sheets that are stapled together from the sheet table and feed them to the separating roller, the separating roller can not separate one sheet, because they are stapled, so that it can cause a sheet-jam that can damage the sheet feeding apparatus or the subsequent structure. To prevent feeding of stapled sheets, some sheet feeding apparatuses have means for detecting stapled sheets.

When one sheet from a stack of stapled sheets is picked-up with a roller, that sheet becomes slanted because it can not move freely due to the staple. If that sheet is transported further, it gets looped. By using these facts, Japanese Patent No. 31970029, for example, discloses a sheet feeding apparatus that detects whether a sheet becomes slanted or looped during its feeding, and upon detecting a slanted or looped sheet determines that the sheet maybe stapled together to another sheet.

However, not all stapled sheets become slanted or looped during their feeding so that determination of whether sheets are stapled by detecting slanted sheet may not always be successful. Sometimes sheets that are already curled maybe stacked on the sheet table so that determination of whether sheets are stapled by detecting looped sheet may not always be successful.

Thus, there is a need of a technology that can surely detect stapled sheets.

SUMMARY OF THE INVENTION

It is an object of the present invention to at least partially solve the problems in the conventional technology.

According to an aspect of the present invention, a sheet feeding apparatus includes a sheet feeding unit that feeds one sheet at a time from a stack of sheets into a structure; a sheet stopping unit that stops feeding of a second sheet into the structure while the sheet feeding unit is feeding a first sheet into the structure; and a lift detector that detects a lifted portion of the first sheet and the second sheet, the lifted portion being a portion of the first sheet and the second sheet that gets lifted because the first sheets is being fed the sheet feeding unit, the second sheet has been stopped by the sheet stopping unit, and the first sheet and the second sheet being stapled together.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings. Note that this invention will not be limited to the embodiments. Furthermore, constituent elements in the embodiments include replaceable elements or elements easily handled by one skilled in the art, or substantially the same elements.

Figure 1:
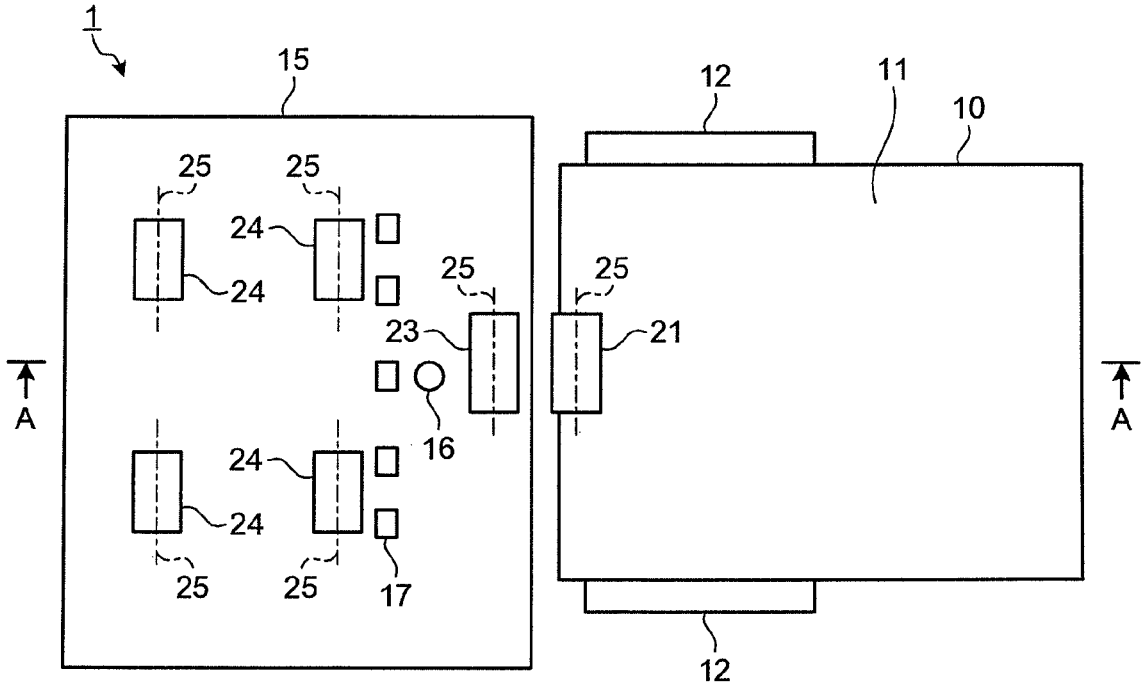
FIG. 1 is plan view of a sheet feeding apparatus according to a first embodiment of the present invention.
Figure 2:
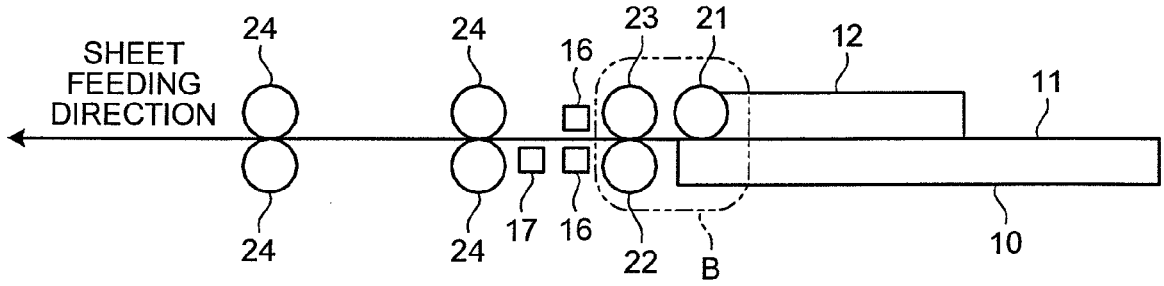
FIG. 2 is a view of the sheet feeding apparatus along a line A-A in FIG. 1.

FIG. 1 is a plan view of a sheet feeding apparatus 1 according to a first embodiment of the present invention. FIG. 2 is a view of the sheet feeding apparatus 1 along a line A-A in FIG.

1. The sheet feeding apparatus 1 includes a sheet table 10 and a feeder 15. The sheet table 10 is configured to hold sheets 50 that are, for example, paper sheets. The feeder 15 feeds a sheet from the sheet table 10 to a subsequent structure (not shown). The sheet table 10 and the feeder 15 are adjacent to each other. A surface 11 of the sheet table 10 where sheets are placed is almost rectangular. A pick roller 21, which is a sheet feeding unit, is rotatably attached to the sheet holding surface 11 toward the feeder 15. The pick roller 21 is elongated and positioned with its central axis 25 extending parallel to the side at which the pick roller 21 is provided. A hopper portion 12 is provided along each sides of the sheet table 10. The hopper portions 12 protrude from the sheet holding surface 11.

A separating roller 23 and a retard roller 22 are rotatably mounted on the feeder 15 toward the sheet table 10. The retard roller 22 is a sheet stopping unit. The separating roller 23 is provided at almost the same position as the pick roller 21 in the direction perpendicular to the sheet holding surface 11. Namely, the pick roller 21 and the separating roller 23 are at almost the same position in the direction of height, as long as the sheet feeding apparatus 1 is used under normal conditions. The retard roller 22 is located below the separating roller 23, or faces the separating roller 23 in the same direction as the sheet table 10 is positioned with respect to the pick roller 21.

Two double-feed detecting sensors 16 are provided on the downstream side of the separating roller 23 and the retard roller 22 with respect to sheet feeding direction. The double-feed detecting sensors 16 detect whether a plurality of the sheets are fed at the same time. One double-feed detecting sensor 16 is provided respectively for the separating roller 23 and the retard roller 22. A plurality of skew detecting sensors 17 are provided on the downstream side of the double-feed detecting sensor 16 corresponding to the retard roller 22 and the skew detecting sensors 17 are aligned perpendicular to the sheet feeding direction. The skew detecting sensors 17 detect whether a sheet becomes slanted while the sheet is being fed. The double-feed detecting sensors 16 use an infrared beam to detect whether a plurality of sheets are fed at the same time. Similarly, the skew detecting sensors 17 use an infrared beam to detect whether a sheet becomes slanted. The double-feed detecting sensors 16 and the skew detecting sensors 17, however, can use some other medium, such as ultrasonic waves, to perform their respective functions.

Two pairs of feed rollers 24 are provided on the downstream side of the skew detecting sensors 17. The feed rollers 24 of each pair lie at the same position as the separating roller 23 and the retard roller 22, respectively. The separating roller 23, the retard roller 22, and the feed rollers 24 are elongated, and their axis of rotation is perpendicular to the sheet feeding direction.

Figure 3:
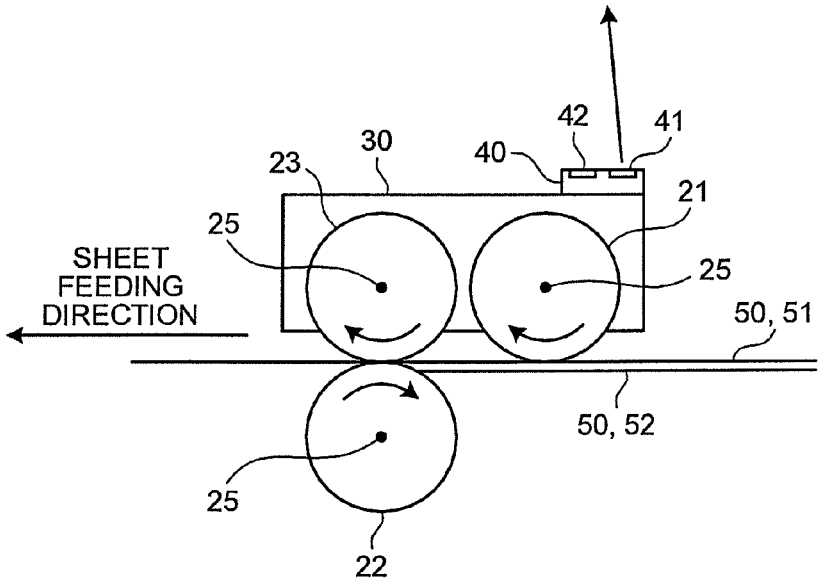
FIG. 3 is a detailed view of a part B in FIG. 2.

FIG. 3 is a detailed view of a part B in FIG. 2. The pick roller 21 and the separating roller 23 are set in a roller case 30. They are formed integral with the roller case 30. The pick roller 21 and the separating roller 23 protrude from the bottom of the roller case 30 to the sheet holding surface 11 (see FIG. 2). That is, the pick roller 21 and the separating roller 23 have their lower parts projecting from the roller case 30. An electric motor (not shown) drives and rotates the separating roller 23 around its central axis 25. The separating roller 23 and the pick roller 21 are coupled with a belt and pulley structure (not shown). The rotation of the separating roller 23 is therefore transmitted to the pick roller 21. Thus, the pick roller 21 rotates around its central axis 25 when the separating roller 23 rotates. Like the separating roller 23, an electric motor (not shown) drives and rotates the retard roller 22 around its central axis 25.

The pick roller 21, the separating roller 23 and the retard roller 22 can rotate, all in the same direction. More specifically, the pick roller 21 rotates in the same direction as the separating roller 23. Namely, the part of the pick roller 21 that protrudes from the roller case 30 moves in the same direction as the part of the separating roller 23 that protrudes from the roller case 30. The separating roller 23 and the retard roller 22 can rotate in the same direction as the pick roller 21. Therefore, the parts of the separating roller 23 and the retard roller 22, which face each other, move in the opposite directions. That is, the retard roller 22 can rotate such that its part facing the separating roller 23 moves toward the pick roller 21.

The separating roller 23 is fixed at a specific position with respect to the feeder 15 (see FIG. 1). The roller case 30 and the pick roller 21 formed integral with the roller case 30 and hence with the separating roller 23 can rotate around the central axis 25 of the separating roller 23. The pick roller 21 can therefore be moved away from the sheet holding surface 11. The pick roller 21 and the roller case 30 tend to rotate downwards around the central axis 25 of the separating roller 23, by virtue of their own weights. In other words, they are biased toward the sheet holding surface 11. Thus, the pick roller 21 contacts the sheet holding surface 11 while the sheet holding surface 11 remains below the pick roller 21. The retard roller 22 is pushed onto the separating roller 23 by a biasing unit (not shown) such as a spring.

A lift detecting sensor 40, which is a lift detecting unit, is mounted on the roller case 30. The lift detecting sensor 40 is provided on that surface of the roller case 30 that faces away from the surface from which the pick roller 21 and the separating roller 23 protrude. In other words, the lift detecting sensor 40 is mounted on the top of the roller case 30. That is, the lift detecting sensor 40 is located above a sheet 51 (later described) across the pick roller 21. The lift detecting sensor 40 includes a beam emitting unit 41 and a beam detecting unit 42. The beam emitting unit 41 emits an infrared beam and the beam detecting unit 42 detects the infrared beam emitted from the beam emitting unit 41 and then reflected by some object (not shown).

The sheet feeding apparatus 1 operates as below. To feed a sheet 50 by the sheet feeding apparatus 1, the sheet 51 is placed on the sheet holding surface 11 of the sheet table 10. In this state, the motors drive the separating roller 23 and the retard roller 22. The separating roller 23 and the retard roller 22 therefore rotate. As the separating roller 23 rotates, the pick roller 21 also rotates.

The pick roller 21 contacts the sheet 50 placed on the sheet holding surface 11, or vice versa, and frictional force is generated between the pick roller 21 and the sheet 50 so that the sheet 50 is picked up and it passes through a gap between the pick roller 21 and the separating roller 23. For the sake of explanation, the sheet that is placed on the sheet table 10 will be referred to as the sheet 50 and the sheet that is fed between the pick roller 21 and the separating roller 23 is referred to as a sheet 51. The sheet 51 is then fed toward the feed rollers 24 as the separating roller 23 rotates.

While a part of the sheet 51 is still sandwiched between the pick roller 21 and the separating roller 23, another sheet, a sheet 52, maybe accidentally picked-up due to frictional force between the sheet 51, and that sheet may enter the gap between the pick roller 21 and the separating roller 23. However, sheet-jam can occur if the sheet 52 enters the gap so that the sheet 52 must be stopped from entering the gap. The sheet 52 moves toward the separating roller 23 as the sheet 51 passes between the gap. Nonetheless, the sheet 52 contact the retard roller 22. This is because the separating roller 23 faces the retard roller 22 and also because they are far from the sheet 51 across the pick roller 21.

Those parts of the retard roller 22 and the separating roller 23, which face each other, move in the opposite directions. The part of the retard roller 22 therefore approaches the pick roller 21. The sheet 52 contacting the retard roller 22 is stopped as the retard roller 22 rotates. That is, the sheet 52 is prevented from moving toward the feed rollers 24 or in the sheet feeding direction. Eventually, the sheet 52 is stopped by causing the sheet 52 to abut with the retard roller 22.

Under this condition, the sheet 51 is fed toward the feed rollers 24 away from the pick roller 21 and the separating roller 23. If only one sheet 52 is stopped, this sheet 52 contacts the pick roller 21 or the separating roller 23. The sheet 52 is one to feed. This sheet 51 is fed toward the feed rollers 24. If two or more of the sheets 52 are stopped, one of them, which faces the pick roller 21 or the separating roller 23, contacts the pick roller 21 or the separating roller 23. This sheet 52 is the sheet 51 to feed, and is fed toward the feed rollers 24. The sequence of these operations is repeated, whereby the sheets 50 are fed, one after another, from the sheet holding surface 11 of the sheet table 10.

The beam emitting unit 41 of the lift detecting sensor 40 keeps on emitting an infrared beam while sheets are being picked-up and transported in the sheet feeding apparatus 1. The infrared beam travels in the direction it has been emitted from the beam emitting unit 41.

Figure 4:
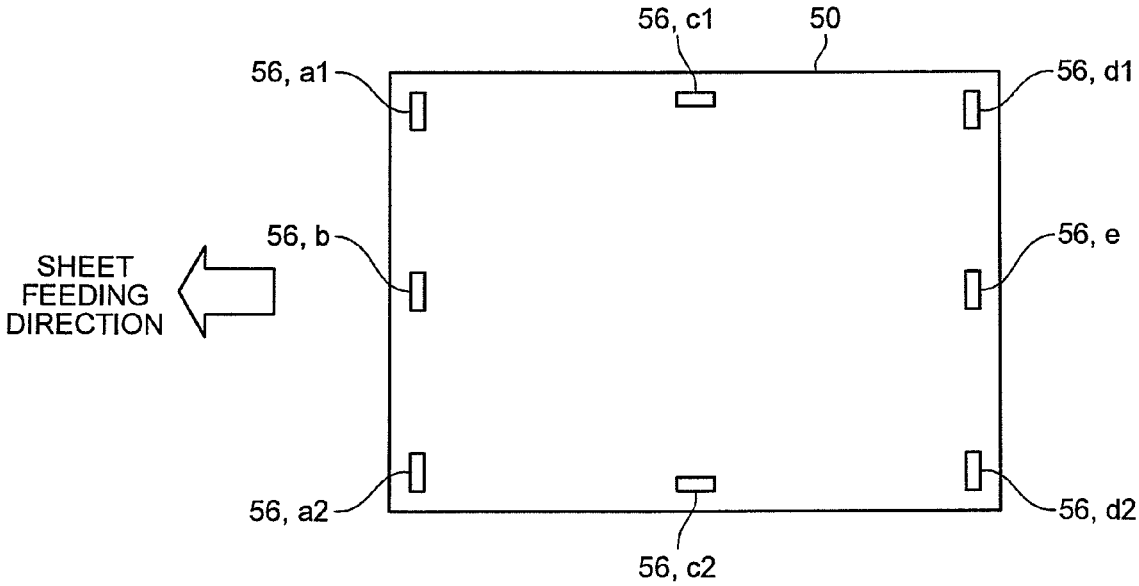
FIG. 4 is an explanatory diagram of positions where sheets are generally stapled together.

FIG. 4 is an explanatory diagram of the positions where sheets are generally stapled together. Of the sheets 50 placed on the sheet holding surface 11, some can be stapled together with, for example, stapling means such as a stapler. A bunch of sheets stapled together will be referred to as stapled sheets 55. In most cases, the sheets 55 can be stapled at one of the edges shown in FIG. 4. Stapled parts a1, a2, and b are at the leading edge of the sheet 50, with the part b existing between the parts a1 and a2. Stapled parts c1 and c2 are at the lateral edges of the sheet 50, respectively. Stapled parts d1, d2, and e located at the trailing edge of the sheet 50, with the part e existing between the parts d1 and da2.

Figure 5:
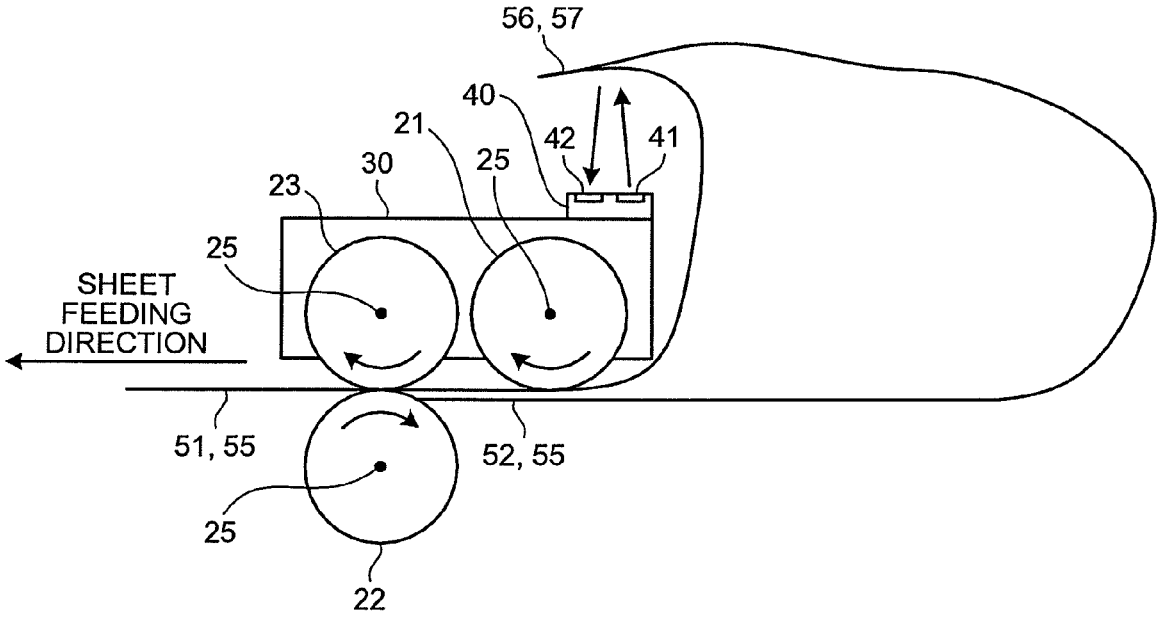
FIG. 5 is a schematic diagram for explaining what happens when the sheet feeding apparatus shown in FIG. 3 feeds stapled sheets.

FIG. 5 is a schematic diagram for explaining how the sheet feeding apparatus shown in FIG. 3 feeds a sheet having a stapled part. Assume that the stapled sheets 55 are placed on the sheet holding surface 11. When one of the sheets 55, e.g., the sheet 50, contacts the pick roller 21, the pick roller 21 feeds this sheet 50. In feeding the stapled sheets 55, the sheet 50 contacting the pick roller 21 is the sheet 51 to the first to feed. Some or all of the other sheets 50 are the sheets 52 that should be stopped. That is, of the stapled sheets 55, only the sheet 50 that contacts the pick roller 21 is the sheet 51 to feed. Thus, the pick roller 21 and the separating roller 23 feed the sheet 51. Any other sheet 50 contacts the retard roller 22 and is prevented from moving in the sheet feeding direction.

In feeding the stapled sheets 55 in this manner, the sheet contacting the pick roller 21 is the sheet 51 to feed, while the other sheets 55 are likely to be the sheets 52 that should be stopped. In this instance, the sheet 51 is stapled to the sheets 52 at a stapled part 56. The stopped sheets 52 are pulled in the sheet feeding direction, at the stapled part 56 only, as the sheet 51 is fed. When the stopped sheets 52 are pulled in the sheet feeding direction, the part of any sheet 52 that is close to the stapled part 56 moves upward from the sheet holding surface 11 and then moves in the sheet feeding direction, if the stapled part 56 exists at a position d1, a position d2, or a position e (see FIG. 4). That is, the part of the sheet 52 that is close to the stapled part 56 is lifted from the sheet holding surface 11, becoming a lifted portion 57. The lifted portion 57 moves to a position remote from those parts of the pick roller 21 that protrude from the roller case 30 or to a position that is far from the sheet 51 fed to the pick roller 21.

When the lifted portion 57 reaches either position, it intercepts the infrared beam emitted from the beam emitting unit 41 of the lift detecting sensor 40, which is mounted on the part of the roller case 30 that exists at the position. The lifted portion 57 of the sheet 52 reflects the infrared beam. The reflected infrared beam travels to the beam detecting unit 42 of the lift detecting sensor 40. The beam detecting unit 42 detects the infrared beam. Accordingly, it is determined that the sheet 52 has the lifted portion 57.

The lift detecting sensor 40 can therefore detect the lifted portion 57, if any, which exits remote from the sheet 51 fed to the pick roller 21. The lifted portion 57 is made the sheet 51 fed is one of the stapled sheets 55. Hence, when the lifted portion 57 is detected, the sheet 51 being fed can be determined as one of the stapled sheets 55, and the stapled sheets 55 can be detected. When the stapled sheets 55 are thus detected, the pick roller 21, the separating roller 23 and the retard roller 22 are stopped, whereby the sheet 51 is no longer fed.

The stapled part 56 of each stapled sheet 55 can exist at position c1 or c2 (see FIG. 4). Also in this case, the stapled part 56 of the sheet 51 being fed, which is one of the stapled sheets 55, is pulled in the sheet feeding direction. Accordingly, the part of the sheet 51, which is near the trailing edge, is lifted. The lift detecting sensor 40 then detects the lifted portion 57. The sheet 51 is therefore determined to be one of the stapled sheets 55.

The stapled part 56 of each stapled sheet 55 can exist at position a1 or a2 (see FIG. 4). If so, the part of one sheet 50 contacting the pick roller 21, which is close to the stapled part 56, is not fed at all. The sheet 51 therefore rotates around a point near the stapled part 56 as fulcrum. The sheet feeding apparatus 1 has the skew detecting sensors 17 that detect any sheet 51 that is positioned askew. When the skew detecting sensors 17 detects that the sheet 51 is askew, the sheet 51 is determined to be one of the stapled sheets 55.

The stapled part 56 of each stapled sheet 55 can exist at position b (see FIG. 4). In this case, when only one sheet 50 contacting the pick roller 21 is fed as the sheet 51, the other sheets 50, i.e., the remaining stapled sheets 55, are also fed. The sheet feeding apparatus 1 has the double-feed detecting sensors 16 that detect a plurality of the sheets 50 are fed at the same time. Thus, when the double-feed detecting sensors 16 that detect plurality of the sheets 50 are simultaneously fed, these sheets 50 are the stapled sheets 55.

The sheet feeding apparatus 1 described above has the lift detecting sensor 40. The lift detecting sensor 40 can detect any lifted portion 57 that is made of one of the stapled sheet 55 while the sheet 51, i.e., another sheet of the stapled sheets 55, is being fed. When the lifted portion 57 is detected, the sheets 55 can be determined to be stapled together. This prevents a sheet already bent or curved, such a curled one, from being detected, by mistake, as a sheet that is stapled together with other sheets, because the lifted portion 57 is lifted from the sheet holding surface 11 by a long distance. Hence, the sheet 51, which is one of the sheets 55 stapled together, can be detected as the sheet 51 being fed by the pick roller 21. As a result, the sheets 50, or sheets stapled together in specific numbers, can be detected with high accuracy.

As described above, the lift detecting sensor 40 is located above the sheet 51 across the pick roller 21. The lift detecting sensor 40 can therefore detect the lifted portion 57 of the sheet 51 with high reliability. That is, as the pick roller 21 feeds the sheet 51, the lifted portion 57 moves up from the sheet holding surface 11 and in the sheet feeding direction. The lifted portion 57 can readily move to a position far from the sheet 51 across the pick roller 21. The lifted portion 57 can therefore be reliably detected. When the lifted portion 57 is detected, the stapled sheets 55 are detected. As a result, the sheets 50 stapled together can be detected with high reliability.

The lift detecting sensor 40, which is a lift detecting unit, has the beam emitting unit 41 that emits an infrared beam and the beam detecting unit 42 that detects the infrared beam reflected by the lifted portion 57. The lift detecting unit can therefore detect the lifted portion 57, without using components that mechanically operate. It makes no errors in detecting the lifted portion 57, unlike detecting units that incorporate mechanical components. Accordingly, the lift detecting sensor 40 can reliably detect the sheets 50 stapled together.

Since the sheets 50 stapled together in specific numbers can be detected with high accuracy, the sheets 51 to feed can be stopped with high reliability in the process of feeding the stapled sheets 55. Thus, a jam of the sheets 50 and damage to the sheets 50 can be suppressed while the sheets 50 are being fed.

Figure 6:
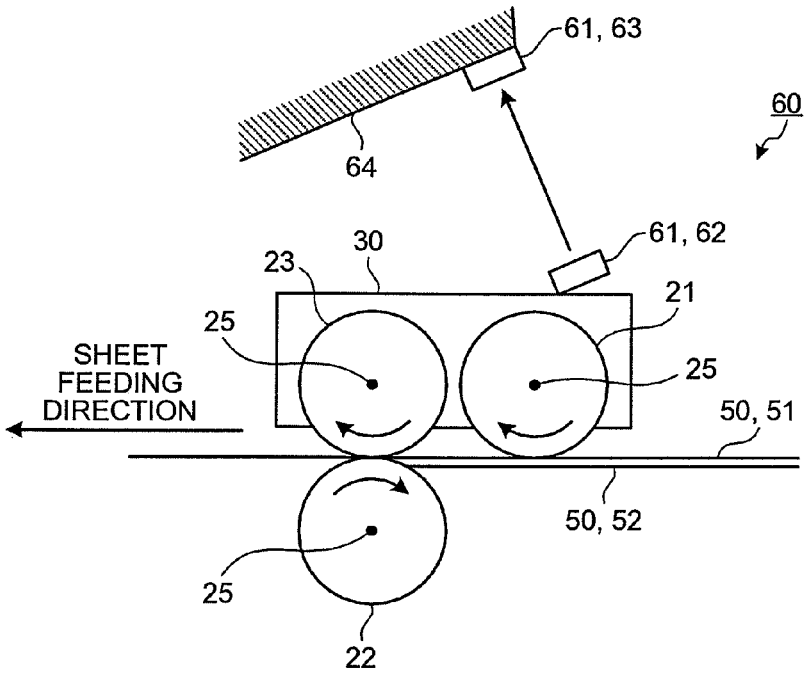
FIG. 6 is a lateral view of relevant parts of a sheet feeding apparatus according to a second embodiment of the present invention.

A sheet feeding apparatus according to a second embodiment of the present invention is substantially identical in structure to the sheet feeding apparatus according to the first embodiment. It differs only in that the beam emitting unit and beam detecting unit of the lift detecting sensor 40 oppose each other. It is similar to the first embodiment in any other structural respect. Therefore, the components identical or similar to those of the first embodiment are designated with like reference numerals and will not be described in detail. FIG. 6 is a schematic diagram of relevant parts of a sheet feeding apparatus 60 according to the second embodiment. As shown in FIG. 6, the sheet feeding apparatus 60 includes the pick roller 21 and the separating roller 23, which are formed integral with the roller case 30, as the sheet feeding apparatus 1 according to the first embodiment. The retard roller 22 is opposed to the separating roller 23. A beam emitting unit 62 of a lift detecting sensor 61 is mounted on the roller case 30. It is located near the part of the pick roller 21 or the separating roller 23 that faces away from the part at which the sheet 51 is fed. The beam emitting unit 62 is secured to the roller case 30. A cover 64 is provided, remote from the roller case 30. On the cover 64, a beam detecting unit 63 of the lift detecting sensor 61 is mounted. The beam detecting unit 63 is opposed to the beam emitting unit 62 that is mounted on the roller case 30.

The sheet feeding apparatus 60 according to the second embodiment, which is configured as described above, operates as will be explained below. When the sheet feeding apparatus 60 is started, the pick roller 21, the separating roller 23 and the retard roller 22 rotate. As the pick roller 21 rotates, the sheet 50 contacting the pick roller 21, i.e., the sheet 51 to feed, is fed toward the separating roller 23. The pick roller 21 and the separating roller 23 feed the sheet 51 to the feed rollers 24 (see FIG. 1). The sheet 52 that should be stopped, i.e., the sheet 50 spaced apart from the pick roller 21 across the sheet 51 to feed, moves toward the retard roller 22 as the sheet 51 is fed. The sheet 52 stops moving in the sheet feeding direction as the retard roller 22 rotates.

In the sheet feeding apparatus 60 according to the second embodiment, the beam emitting unit 62 of the lift detecting sensor 61 keeps emitting an infrared beam, i.e., detecting waves, while the sheet feeding apparatus 60 is operating. The infrared beam travels to the beam detecting unit 63 that faces the beam emitting unit 62. The beam detecting unit 63 keeps detecting the infrared beam from the beam emitting unit 62.

Figure 7:
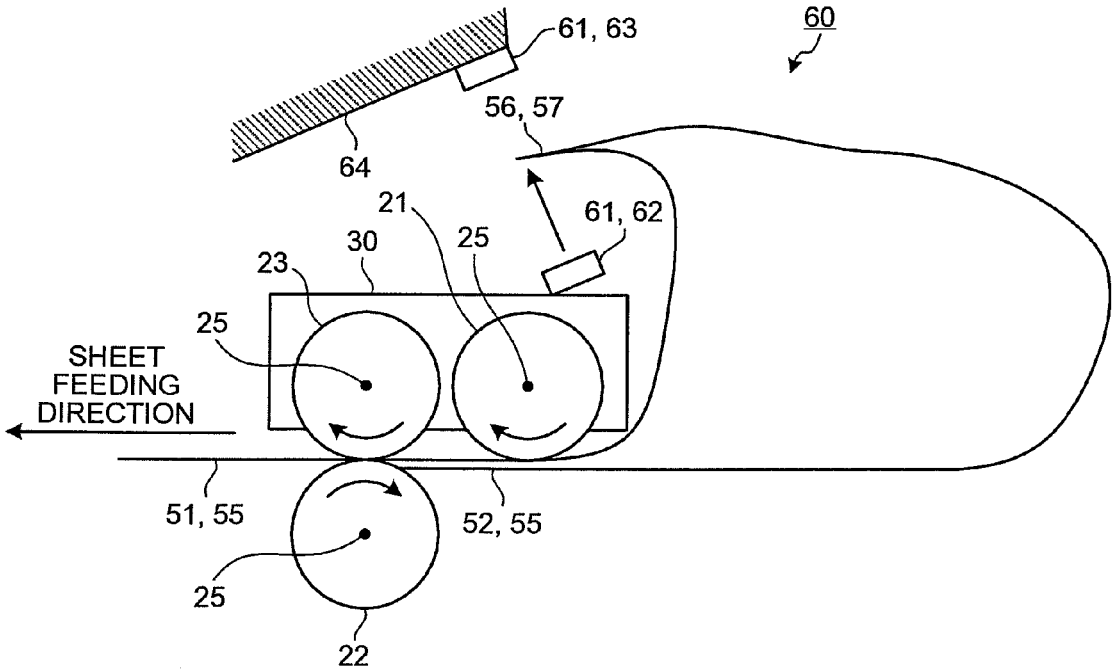
FIG. 7 is a schematic diagram for explaining what happens when the sheet feeding apparatus shown in FIG. 6 feeds stapled sheets.

FIG. 7 is a schematic diagram for explaining how the sheet feeding apparatus shown in FIG. 6 feeds a sheet having a stapled part. The sheets 50 that the sheet feeding apparatus 60 feeds can include the sheets 55 stapled together. If the stapled part 56 of each stapled sheet 55 exists at positions d1, d2, or e (see FIG. 4), the part of the sheet 55 that is close to the stapled part 56 is lifted, making the lifted portion 57. The lifted portion 57 moves to the part of the roller case 30 or the pick roller 21 that is remote from the sheet 51 to feed.

When the lifted portion 57 reaches either position, it intercepts the infrared beam emitted from the beam emitting unit 62 of the lift detecting sensor 61, which is mounted on the part of the roller case 30 that lies at the position. Therefore, the infrared beam emitted from the beam emitting unit 62 is intercepted by the lifted portion 57 and does not reach the beam detecting unit 63. When the beam detecting unit 63 detects no infrared beams, it is determined that the lifted portion 57 exists.

If the lifted portion 57 is remote from the sheet 51 being fed, across the pick roller 21, the lift detecting sensor 61 can detect the lifted portion 57. When the lifted portion 57 is thus detected, the stapled sheets 55 can be detected in the same way as in the sheet feeding apparatus 1 according to the first embodiment. When the stapled sheets 55 are thus detected, the feeding of the sheet 51 is stopped.

The sheet feeding apparatus 60 described above has the beam emitting unit 62 that emits an infrared beam, i.e., detecting waves, and the beam detecting unit 63 that detects the infrared beam emitted from the beam emitting unit 62. The lifted portion 57 is detected according to whether it intercepts the infrared beam. If the beam detecting unit 63 does not detect the infrared beam, it can be determined that the lifted portion 57 intercepts the infrared beam. Thus, it is reliably recognized that the lifted portion 57 has been made. If the lifted portion 57 is thus detected, the stapled sheets 55 are detected. Accordingly, the sheets 50 stapled together in specific numbers can be detected with high reliability.

Figure 8:
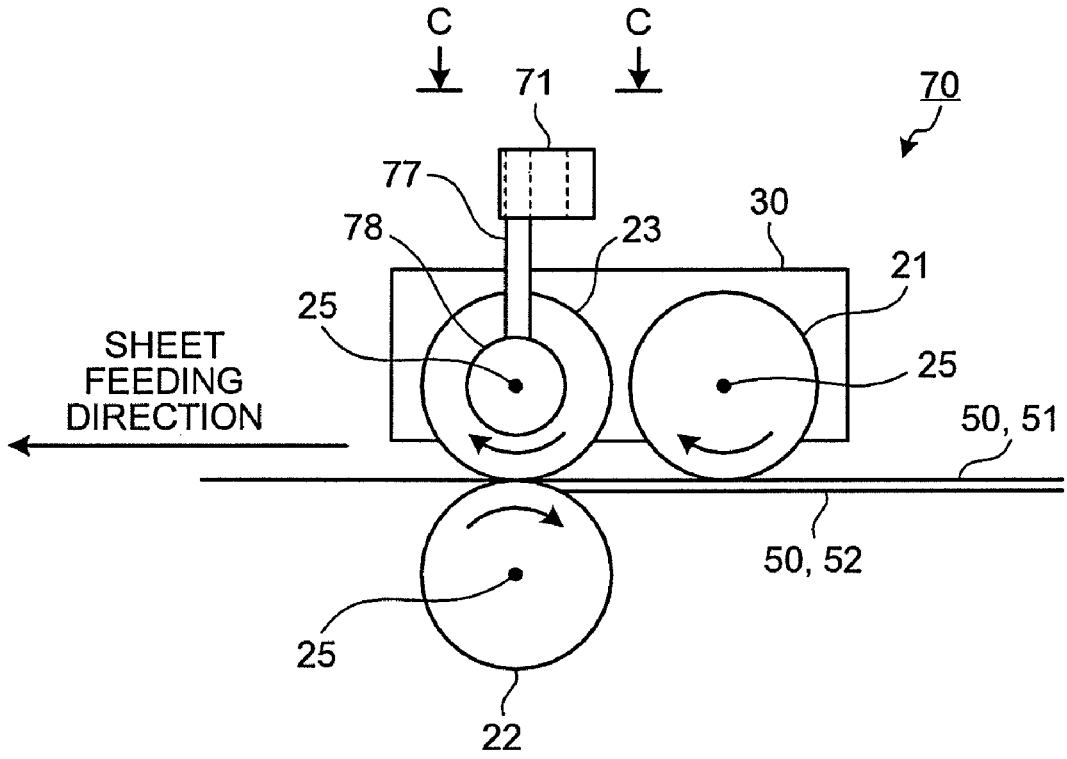
FIG. 8 is a lateral view of relevant parts of a sheet feeding apparatus according to a third embodiment of the present invention.

A sheet feeding apparatus according to a third embodiment of the present invention is substantially identical in structure to the sheet feeding apparatus according to the first embodiment. It differs in that the lift detecting unit has a lift detecting sensor and a shielding unit. It is similar to the first embodiment in any other structural respect. The components identical or similar to those of the first embodiment are designated with like reference numerals and will not be described in detail. FIG. 8 is a schematic diagram of relevant parts of a sheet feeding apparatus 70 according to the third embodiment. The sheet feeding apparatus 70 includes the pick roller 21 and the separating roller 23, which are formed integral with the roller case 30, like the sheet feeding apparatus 1 according to the first embodiment. The retard roller 22 is opposed to the separating roller 23. The roller case 30 and the pick roller 21 can rotate around the central axis 25 of the separating roller 23, in the same way as in the sheet feeding apparatus 1 according to the first embodiment. Further, the roller case 30 contains a rotary unit 78 that is located near the separating roller 23. The rotary unit 78 rotates around the central axis 25 of the separating roller 23 as the roller case 30 rotates.

A shielding unit 77 is provided on the rotary unit 78. The shielding unit 77 is a rod-shaped member that extends upwards through the roller case 30, in the direction away from the sheet 51. Near the distal end of the shielding unit 77, a lift detecting sensor 71 is provided, remote from the rotary unit 78. The shielding unit 77 and the lift detecting sensor 71 constitute a lift detecting unit. The lift detecting sensor 71 is secured to a member that does not move relative to the sheet table 10 (see FIG. 2) while the sheet feeding apparatus 70 is operating. For example, the lift detecting sensor 71 can be secured to the cover 64 of the sheet feeding apparatus 60 according to the second embodiment.

Figure 9:
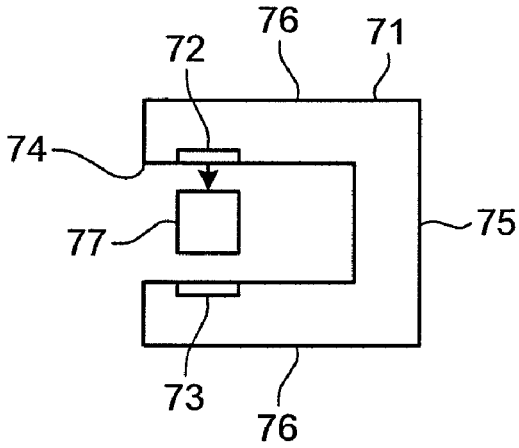
FIG. 9 is a front view of the sheet feeding apparatus along a line C-C in FIG. 8.

FIG. 9 is a front view of the sheet feeding apparatus 70 along a line C-C in FIG. 8. The lift detecting sensor 71 looks like a horseshoe as viewed from above, or as viewed from a point above the roller case 30 and remote from the sheet 51 to feed. The lift detecting sensor 71 is so positioned that its opening portion 74 is oriented in the sheet feeding direction.

The lift detecting sensor 71 includes a beam emitting unit 72 and a beam detecting unit 73. The beam emitting unit 72 and the beam detecting unit 73 are provided on the opposing parts of the horseshoe-shaped lift detecting sensor 71. More specifically, they are provided on lateral parts 76 extending from the ends of the coupling part 75 that is far from the opening portion 74 and that couples the lateral parts 76. The beam emitting unit 72 is provided on one of the lateral parts 76, and the beam detecting unit 73 is provided on the other lateral part 76. The beam emitting unit 72 and the beam detecting unit 73 face each other.

The sheet feeding apparatus 70 according to the third embodiment is configured as described above. Its operation will be explained below. When the sheet feeding apparatus 70 is started, the pick roller 21, the separating roller 23 and the retard roller 22 rotate. The sheet 51 is fed toward the feed roller (see FIG. 1), and the sheet 52 stops moving in the sheet feeding direction as the retard roller 22 rotates. In this state, the shielding unit 77 lies between the lateral parts 76 of the lift detecting sensor 71 (see FIG. 9). Hence, in this state, the shielding unit 77 remains between the beam emitting unit 72 and the beam detecting unit 73 that oppose each other.

While the sheet feeding apparatus 70 is operating, the beam emitting unit 72 of the lift detecting sensor 71 keeps emitting an infrared beam toward the beam detecting unit 73. The infrared beam travels to the beam detecting unit 63 that faces the beam emitting unit 62. The beam detecting unit 63 keeps detecting the infrared beam.

Figure 10:
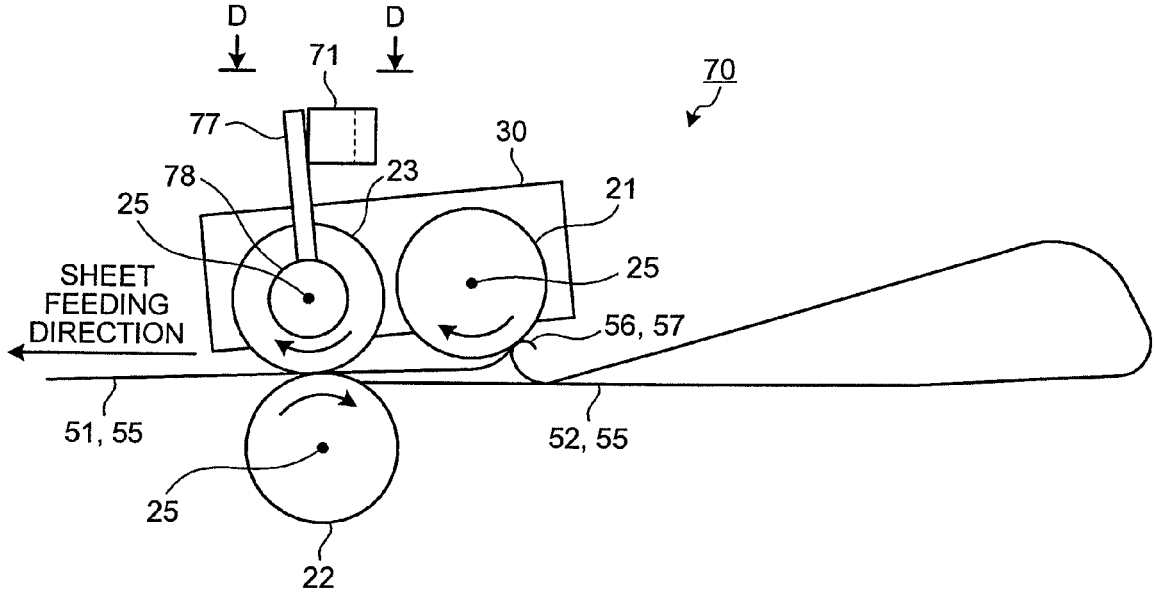
FIG. 10 is a schematic diagram for explaining what happens when the sheet feeding apparatus shown in FIG. 8 feeds stapled sheets.

FIG. 10 is a schematic diagram for explaining how the sheet feeding apparatus shown in FIG. 8 feeds a sheet having a stapled part. The sheets 50 that the sheet feeding apparatus 70 feeds can include the sheets 55 stapled together. If the stapled part 56 of each stapled sheet 55 exists at position e (see FIG. 4), the part of the sheet 55 that is close to the stapled part 56 is lifted, making the lifted portion 57. Position e at which the stapled part 56 exists is near the midpoint on the trailing edge of the sheet 55, even if the stapled part 56 is pulled in the sheet feeding direction when the sheet 51 included in the sheets 55 is fed. Thus, the lifted portion 57 may not rise so much as in the case that the sheet 55 has the lifted portion 57 at an end of the trailing edge, i.e., the position d1 or the position d2. In this case, the lifted portion 57 moves toward the pick roller 21, not lifted so much or not spaced from the sheet holding surface 11 so much.

As the sheet 51 is fed, the lifted portion 57 is pulled and moves toward the pick roller 21. Even after the lifted portion 57 contacts the pick roller 21, it keeps moving in the sheet feeding direction. That is, the lifted portion 57 continuously moves in the sheet feeding direction. While the lifted portion 57 is so moving, the pick roller 21 remains contacting the sheet 50 or the sheet holding surface 11 (see FIG. 2), by virtue of its weight. If the lifted portion 57 can enter a gap between the pick roller 21 and the sheet 50 as it further moves in the sheet feeding direction, the pick roller 21 will move onto the lifted portion 57 as the roller case 30 rotates around the central axis 25 of the separating roller 23. When the pick roller 21 so moves, it rotates around the central axis 25 of the separating roller 23, along with the roller case 30. The rotary unit 78 and the shielding unit 77, which are provided on the roller case 30 and the rotary unit 78, respectively, rotate around the central axis 25 of the separating roller 23 as the roller case 30 rotates.

Figure 11:
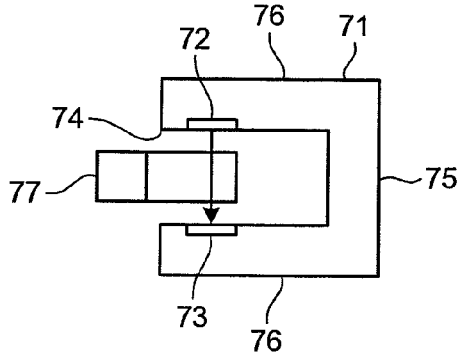
FIG. 11 is a front view of the sheet feeding apparatus along a line D-D in FIG. 10.

FIG. 11 is a cross section taken along a line D-D in FIG. 10. As the roller case 30 rotates as described above, the shielding unit 77 rotates and inclines. Accordingly, the end of the shielding unit 77 that lies at the lift detecting sensor 71 moves in the sheet feeding direction. The opening portion 74 of the horseshoe-shaped lift detecting sensor 71 opens in the sheet feeding direction. The shielding unit 77, which is positioned between the lateral parts 76 of the lift detecting sensor 71, inclines as the roller case 30 rotates. The shielding unit 77 eventually moves out of the space between the lateral parts 76, or comes out of the opening portion 74.

Once the shielding unit 77 comes out of the space between the lateral parts 76, the infrared beam emitted from the beam emitting unit 72 provided on one lateral part 76 reaches the beam detecting unit 73 provided on the other lateral part 76. The shielding unit 77 therefore moves from the space between the beam emitting unit 72 and the beam detecting unit 73. The infrared beam, which has been intercepted by the shielding unit 77 during the sequentially feeding of the sheets 51, reaches the beam detecting unit 73 after the shielding unit 77 comes out of the space between the lateral parts 76. The beam detecting unit 73 detects the infrared beam. It is therefore determined that the sheet 55 has the lifted portion 57.

As described above, the lift detecting sensor 71 and the shielding unit 77 serve to detect the lifted portion 57 when the lifted portion 57 goes into a gap between the pick roller 21 and the sheet 52 stopped. When the lifted portion 57 is detected, the stapled sheet 55 can be detected in the same manner as in the sheet feeding apparatus 1 according to the first embodiment. When the stapled sheet 55 is detected, the feeding of the sheet 51 is interrupted.

In the sheet feeding apparatus 70 described above, the lift detecting sensor 71 and the shielding unit 77 that constitute a lift detecting unit detects the positional changes that the pick roller 21 undergoes when it moves the lifted portion 57. Depending on how the sheets 50 are stapled together, the lifted portion 57 can move to the pick roller 21 while the sheet 51 is being fed with the stapled part 56 remains at position e. As the pick roller 21 moves the lifted portion 57, its position changes according to the height of the lifted portion. The lifted portion 57 can therefore be detected more reliably when the lift detecting sensor 71 and the shielding unit 77 detect the positional change of the pick roller 21. More specifically, the pick roller 21 rotates around the central axis 25 of the separating roller 23 as the lifted portion 57 moves upward. As the pick roller 21 so rotates, the shielding unit 77 rotates. The lift detecting sensor 71 can therefore detect this rotation of the shielding unit 77. The positional change of the pick roller 21 can therefore be detected. This achieves reliable detection of the lifted portion 57. Accordingly, the sheets 50 stapled together can be detected with high reliability.

Assume the sheet 50 that is curled is fed to the pick roller 21. As the curled sheet 50 passes under the pick roller 21, it is flattened due to the weights of the pick roller 21 and the roller case 30. Thus, the curled sheet 50 does not rotate the pick roller 21 around the central axis 25 of the separating roller 23. This reduces errors of detecting the curled sheet 50 as a sheet that is stapled together with other sheets. Hence, it can be reliably determined that the pick roller 21 is feeding the sheet 51, which is one of stapled sheets 55. Accordingly, the sheets 55 stapled together in specific numbers, can be detected with high accuracy.

The shielding unit 77 intercepts the infrared beam when the pick roller 21 rotates, changing in position. The lifted portion 57 is thereby detected. Thus, the lift detecting sensor 71 and the shielding unit 77, which constitute a lifted portion detecting unit, do not contact the lifted portion 57 at all. In other words, neither the lift detecting sensor 71 nor the shielding unit 77 needs to contact the lifted portion 57. Hence, detection failure of the lifted portion 57 caused by poor contact can be suppressed. As a result, the sheets 50 stapled together in specific numbers can be detected with higher reliability than otherwise.

Figure 12:
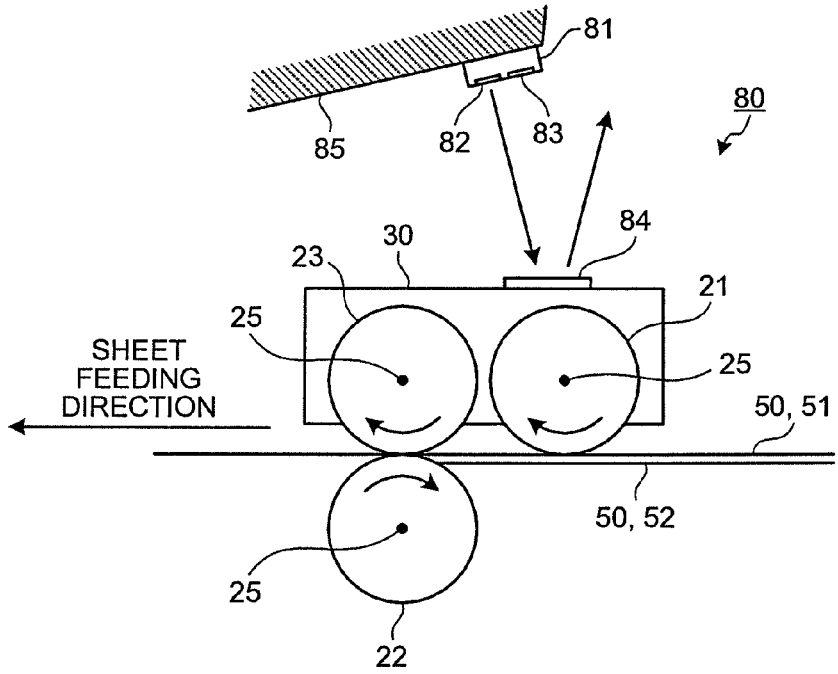
FIG. 12 is a lateral view of relevant parts of a sheet feeding apparatus according to a fourth embodiment of the present invention.

A sheet feeding apparatus according to a fourth embodiment of the present invention is substantially identical in structure to the sheet feeding apparatus according to the third embodiment. It differs in that the lift detecting unit has a lift detecting sensor and a reflector. It is similar to the third embodiment in any other structural respect. Therefore, the components identical or similar to those of the third embodiment are designated with like reference numerals and will not be described in detail. FIG. 12 is a schematic diagram of relevant parts of a sheet feeding apparatus 80 according to the fourth embodiment of the present invention. As shown in FIG. 12, this sheet feeding apparatus 80 has the pick roller 21 and the separating roller 23, which are formed integral with the roller case 30, as the sheet feeding apparatus 70 according to the third embodiment. The retard roller 22 is opposed to the separating roller 23. The roller case 30 and the pick roller 21 can rotate around the central axis 25 of the separating roller 23, in the same way as in the sheet feeding apparatus 70 according to the third embodiment.

A reflector 84 is provided above the pick roller 21, or on that side of the roller case 30 that faces away from the sheet 51 to feed. The reflector 84, which is a part of the lift detecting unit, is secured to the roller case 30. The cover 64 is provided, remote from the roller case 30, as in the sheet feeding apparatus 60 according to the second embodiment. On the cover 64, a lift detecting sensor 81 is mounted. The lift detecting sensor 81, which is a part of the lift detecting unit, has a beam emitting unit 82 that emits an infrared beam and a beam detecting unit 83 that detects the infrared beam.

The sheet feeding apparatus 80 according to the fourth embodiment is configured as described above. Its operation will be explained below. When the sheet feeding apparatus 80 is started, the pick roller 21, the separating roller 23 and the retard roller 22 rotate. The sheet 51 is fed toward the feed roller (see FIG. 1), and the sheet 52 stops moving in the sheet feeding direction as the retard roller 22 rotates.

While the sheet feeding apparatus 80 is operating, the beam emitting unit 82 of the lift detecting sensor 81 keeps emitting an infrared beam toward the reflector 84 secured to the roller case 30. The reflector 84 reflects the infrared beam in a direction other than the direction of the lift detecting sensor 81 while the sheet feeding apparatus 80 keeps feeding the sheets 51 one by one. Under this condition, the beam detecting unit 83 does not detect the infrared beam emitted from the beam emitting unit 82 of the lift detecting sensor 81 and reflected by the reflector 84.

Figure 13:
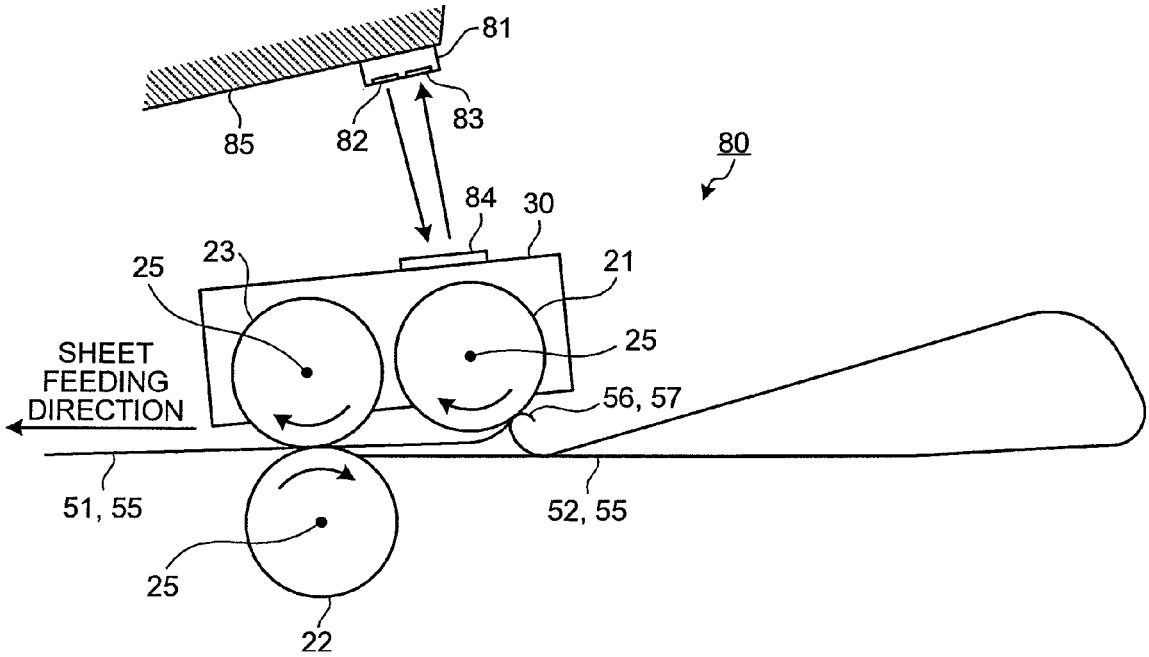
FIG. 13 is a schematic diagram for explaining what happens when the sheet feeding apparatus shown in FIG. 12 feeds stapled sheets.

FIG. 13 is a schematic diagram for explaining how the sheet feeding apparatus shown in FIG. 12 feeds a sheet having a stapled part. The sheet feeding apparatus 80 feed the stapled sheets 55 including the sheet 51, in the same way as the sheet feeding apparatus 70 according to the third embodiment. If the stapled part 56 of each stapled sheet 55 is small and exists at position e (see FIG. 4), the stapled sheet 55 has a small lifted portion 57. The lifted portion 57 is pulled toward the pick roller 21 as the sheet 51 is fed. The lifted portion 57 therefore contacts the pick roller 21. If the lifted portion 57 enters the gap between the pick roller 21 and the sheet 52 stopped, the pick roller 21 will rotate around the central axis 25 of the separating roller 23, riding onto the lifted portion 57. As the pick roller 21 so rotates, the roller case 30 containing the pick roller 21 also rotates. The reflector 84, which is secured to the roller case 30, also rotates around the central axis 25 of the separating roller 23.

When the reflector 84 secured to the roller case 30 rotates as the roller case 30 rotates, the direction in which the reflector 84 reflects the infrared beam changes. That is, the reflector 84 guides the infrared beam emitted from the beam emitting unit 82, to the lift detecting sensor 81. The infrared beam thus reflected is detected by the beam detecting unit 83. If the beam detecting unit 83 detects the infrared beam, it is determined that the stapled sheet 55 has the lifted portion 57.

If the lifted portion 57 enters the gap between the pick roller 21 and the sheet 52 stopped, the lift detecting sensor 81 and the reflector 84 can detect the lifted portion 57. Upon detecting the lifted portion 57, the stapled sheet 55 is detected in the same manner as in the sheet feeding apparatus 70 according to the third embodiment. When the stapled sheet 55 is detected, the feeding of the sheet 51 is interrupted.

In the sheet feeding apparatus 80 described above, the lift detecting unit is constituted of the lift detecting sensor 81 and the reflector 84 that reflects the infrared beam. The lift detecting sensor 81 has the beam emitting unit 82 and the beam detecting unit 83. The reflector 84 changes the direction in which it reflects the infrared beam, according to the positional change of the pick roller 21. Hence, the positional change of the pick roller can be easily determined. Any stapled sheet 55 can be detected from this positional change of the pick roller 21. As a result, the sheets 50 stapled in specific numbers can be detected more easily.

Figure 14:
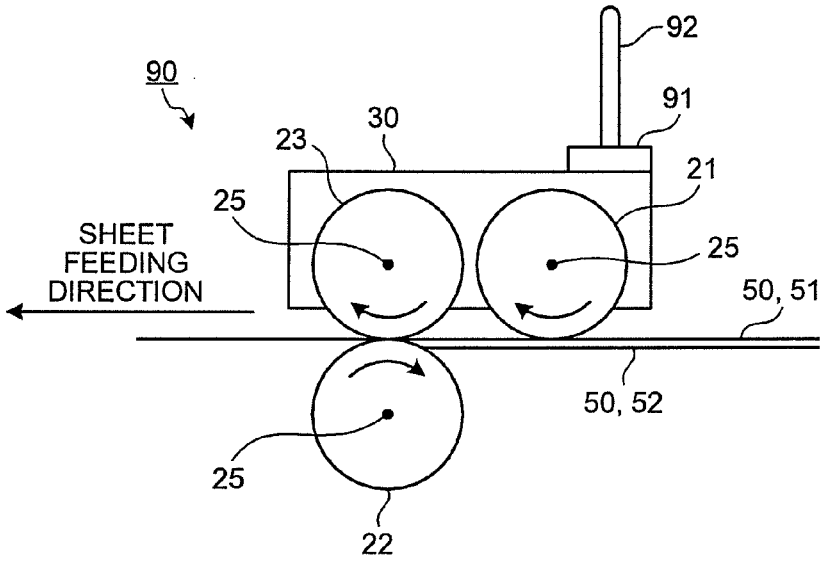
FIG. 14 is a lateral view of relevant parts of a sheet feeding apparatus according to a fifth embodiment of the present invention.

A sheet feeding apparatus according to a fifth embodiment of the present invention is substantially identical in structure to the sheet feeding apparatus according to the first embodiment. It differs in that the lift detecting sensor is a contact-type one. It is similar to the first embodiment in any other structural respect. Therefore, the components identical or similar to those of the first embodiment are designated with like reference numerals and will not be described in detail. FIG. 14 is a schematic diagram of relevant parts of a sheet feeding apparatus 90 according to a fifth embodiment of the present invention. As shown in FIG. 14, the sheet feeding apparatus 90 has the pick roller 21 and the separating roller 23, which are formed integral with the roller case 30, as the sheet feeding apparatus 1 according to the first embodiment. The retard roller 22 is opposed to the separating roller 23. The lift detecting sensor 91 is located on that side of the roller case 30 that faces away from the side where the sheet 51 to feed exists. The lift detecting sensor 91 is secured to the roller case 30.

The lift detecting sensor 91 has a contact portion 92 on the side facing away from the roller case 30. The contact portion 92 is shaped like a bar and extends upwards, away from the roller case 30. The contact portion 92 has elasticity and is bent when it is exerted with a load. When the contact portion 92 is bent, the lift detecting sensor 91 detects that an object contacts the contact portion 92.

The sheet feeding apparatus 90 according to the fifth embodiment is configured as described above. Its operation will be explained below. When the sheet feeding apparatus 90 is started, the pick roller 21, the separating roller 23 and the retard roller 22 rotate. The sheet 51 is fed toward the feed roller (see FIG. 1), and the sheet 52 stops moving in the sheet feeding direction as the retard roller 22 rotates.

Figure 15:
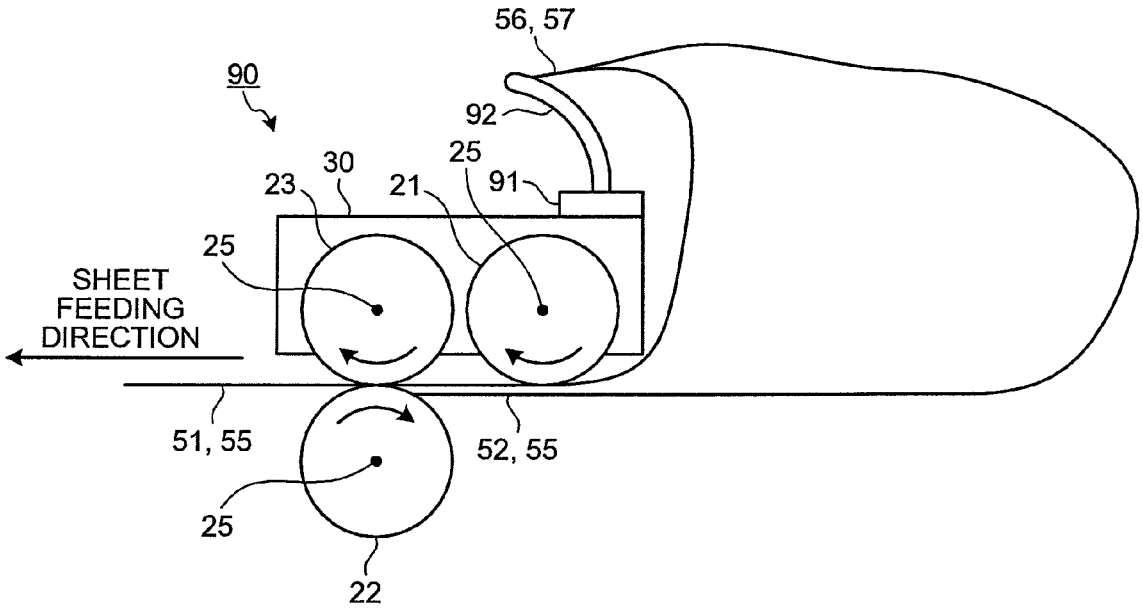
FIG. 15 is a schematic diagram for explaining what happens when the sheet feeding apparatus show in FIG. 14 feeds stapled sheets.

FIG. 15 is a schematic diagram for explaining how the sheet feeding apparatus shown in FIG. 14 feeds a sheet having a stapled part. The sheets 50 that the sheet feeding apparatus 90 feeds can include the sheets 55 that are stapled together in specific numbers, and any sheet 55 can have the stapled part 56 at the position d1, d2, or e (see FIG. 4). In this case, a part near the stapled part 56 rises, becoming the lifted portion 57, and moves to that side of the pick roller 21 that is opposite to the side where the sheet 51 exists.

When the lifted portion 57 moves to the side of the pick roller 21, it touches the bar-shaped contact portion 92 of the lift detecting sensor 91. This is because the contact portion 92 is located at the of the pick roller 21. When the lifted portion 57 touches the contact portion 92, the contact portion 92 is bent because it has elasticity. As the contact portion 92 is bent, the lift detecting sensor 91 detects an object that touches the contact portion 92. Thus, the lifted portion 57 is determined to have touched the contact portion 92 if the contact portion 92 is bent. That is, it is determined that the sheet 55 has the lifted portion 57.

If the lifted portion 57 exists at that side of the pick roller 21 that is opposite to the side where the sheet 51 exists, the lift detecting sensor 91 can detect the lifted portion 57. When the lifted portion 57 is thus detected, the stapled sheet 55 is detected in the same way as in the sheet feeding apparatus 1 according to the first embodiment. The moment the stapled sheet 55 is detected, the feeding of the sheet 51 is stopped.

In the sheet feeding apparatus 90 described above, the lift detecting sensor 91 detects the lifted portion 57 when the lifted portion 57 touches the contact portion 92. Hence, the lifted portion 57 can be reliably detected. As a result, the sheets 50 stapled together can be detected more reliably than otherwise.

As described above, an infrared beam is used as detecting waves. Nonetheless, the detecting waves can be other than an infrared beam. Any other waves can be used, only if they serve to detect lifted portions 57. For example, ultrasonic waves can be utilized instead. In the sheet feeding apparatus 1 according to the first embodiment, the lift detecting sensor 40 is provided on the roller case 30, and similarly, in the sheet feeding apparatus 90 according to the fifth embodiment, the lift detecting sensor 91 is provided on the roller case 30. Nonetheless, the lift detecting sensors 40 and 91 can be provided on the cover 64 as used in the sheet feeding apparatus 60 according to the second embodiment.

In the sheet feeding apparatus 60 according to the second embodiment, the beam emitting unit 62 of the lift detecting sensor 61 is provided on the roller case 30, and the beam detecting unit 63 is provided on the cover 64. The beam emitting unit 62 and the beam detecting unit 63 can take each other's position. Similarly, in the sheet feeding apparatus 80 according to the fourth embodiment, the reflector 84 is provided on the roller case 30, and the lift detecting sensor 81 is provided on a cover 85. The reflector 84 and the lift detecting sensor 81 can assume each other's position. In the sheet feeding apparatus 80 according to the fourth embodiment, the beam detecting unit 83 of the lift detecting sensor 81 does not detect the infrared beam reflected by the reflector 84, during the normal operation of the sheet feeding apparatus 80, that is, as long as the sheet feeding apparatus 80 feeds the sheets 50 one by one. The beam detecting unit 83 detects the infrared beam reflected by the reflector 84, only if any paper being fed has the lifted portion 57. This can be other way around. That is, the beam detecting unit 83 can detect the infrared beam during the normal operation of the sheet feeding apparatus 80, and does not detect the infrared beam if any paper being fed has the lifted portion 57.

In the sheet feeding apparatus 70 according to the third embodiment, the shielding unit 77 remains at a position between the beam emitting unit 72 and the beam detecting unit 73 of the lift detecting sensor 71 during the normal operation and intercepts the infrared beam emitted from the beam emitting unit 72 toward the beam detecting unit 73. When any sheet comes to have a lifted portion, the shielding unit 77 moves from the position, allowing the passage of the infrared beam. This can be other way around. That is, the shielding unit 77 does not lie between the beam emitting unit 72 and the beam detecting unit 73 during the normal operation, allowing the passage of the infrared beam, and moves to a position between the beam emitting unit 72 and the beam detecting unit 73, and intercepts the infrared beam when any sheet comes to have the lifted portion 57.

In the sheet feeding apparatus 90 according to the fifth embodiment, the lift detecting sensor 91 has a bar-shaped contact portion 92, which is bent when an object touches it, whereby the lift detecting sensor 91 detects the object. Nonetheless, the lift detecting sensor 91 can be replaced by another type which has a contact portion and which detects any object when the object touches the contact.

The sheet feeding apparatus according to the present invention can be any one of the first to fifth embodiments described above. Alternatively, it can be any possible combination of the first to fifth embodiments and can have only one sheet feeding unit.

The sheet feeding apparatus according to the present invention can detect any sheet stapled with others, at high reliability.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding apparatus comprising:

a sheet feeding unit including a pick roller, wherein the sheet feeding unit is configured to feed one sheet at a time from a stack of sheets into a structure, the one sheet being a first sheet that is a topmost sheet of a stack of sheets;

a sheet stopping unit configured to stop feeding of a second sheet into the structure while the sheet feeding unit is feeding the first sheet into the structure; and a lifted-portion detector disposed above the first sheet across the pick roller, the lifted-portion detector configured to detect a lifted portion formed by the first sheet and the second sheet when the first sheet and the second sheet are stapled together, by detecting beam reflected by the lifted portion above the lifted-portion detector, wherein the lifted portion is a portion of the first sheet and the second sheet that gets lifted and moved to a position above the lifted-portion detector because the first sheet is being fed by the sheet feeding unit while the second sheet has been stopped by the sheet stopping unit;

wherein the lifted-portion detector is configured to emit detecting signals upwards, the lifted-portion detector further configured to detect the detecting signals reflected by the lifted portion when the lifted portion moves to the position above the lifted-portion detector; and wherein the lifted-portion detector is configured to detect the stapled sheets by detecting the lifted portion and interrupt the feeding of the first sheet by the sheet feeding unit.

2. The sheet feeding apparatus according to claim 1, wherein the lifted-portion detector comprises a beam emitting unit that emits waves and a beam detecting unit that detects waves reflected by the lifted portion.

3. The sheet feeding apparatus according to claim 1, wherein the pick roller is set in a roller case and protrudes from a bottom surface of the roller case to a sheet holding surface, and the lifted portion detector is mounted on a surface of the roller case on top thereof.

4. A sheet feeding apparatus comprising:

a sheet feeding unit including a pick roller, wherein the sheet feeding unit is configured to feed one sheet at a time from a stack of sheets into a structure, the one sheet being a first sheet that is a topmost sheet of stack of sheets;

a sheet stopping unit configured to stop feeding of a second sheet into the structure while the sheet feeding unit is feeding the first sheet into the structure; and a lifted-portion detector mounted on a surface of a roller case in which the pick roller is disposed, the surface facing away from another surface from which the pick roller protrudes, so that the lifted-portion detector is located at an end of the roller case near the pick roller and above the first sheet across the pick roller, the lifted-portion detector including a beam emitting unit and a beam detecting unit and configured to detect a lifted portion, formed by the first sheet and the second sheet when the first sheet and the second sheet are stapled together, by detecting beam reflected by the lifted portion above the lifted-portion detector, wherein the lifted portion is a portion of the first sheet and the second sheet that gets lifted and moved to a position above the lifted-portion detector because the first sheet is being fed by the sheet feeding unit while the second sheet has been stopped by the sheet stopping unit;

wherein the lifted-portion detector is configured to emit detecting signals upwards, the lifted-portion detector further configured to detect the detecting signals reflected by the lifted portion when the lifted portion moves to the position above the lifted-portion detector; and wherein the lifted-portion detector is configured to detect the stapled sheets by detecting the lifted portion and interrupt the feeding of the first sheet by the sheet feeding unit.

5. The sheet feeding apparatus according to claim 4, wherein the beam emitting unit emits waves and the beam detecting unit detects waves reflected by the lifted portion.

6. The sheet feeding apparatus according to claim 4, wherein the another surface is a bottom surface and the pick roller is set in the roller case and protrudes from the bottom surface of the roller case to a sheet holding surface, and the lifted-portion detector is mounted on the surface of the roller case on top thereof.

* * * * *